US008356559B2

(12) United States Patent
Kurahashi et al.

(10) Patent No.: US 8,356,559 B2
(45) Date of Patent: Jan. 22, 2013

(54) BOGIE FOR GUIDE RAIL TYPE VEHICLE

(75) Inventors: Hiroki Kurahashi, Mihara (JP); Nobuyuki Fujio, Mihara (JP); Hiroyuki Kono, Hiroshima (JP); Yukihide Yanobu, Hiroshima (JP); Akihisa Kawauchi, Hiroshima (JP); Kousuke Katahira, Kawasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/144,763

(22) PCT Filed: Jul. 6, 2009

(86) PCT No.: PCT/JP2009/062318

§ 371 (c)(1),
(2), (4) Date: Jul. 15, 2011

(87) PCT Pub. No.: WO2010/097973

PCT Pub. Date: Sep. 2, 2010

(65) Prior Publication Data

US 2011/0271868 A1 Nov. 10, 2011

(30) Foreign Application Priority Data

Feb. 26, 2009 (JP) ..... 2009-044565

(51) Int. Cl.
*B61F 1/00* (2006.01)

(52) U.S. Cl. ..... 105/215.2; 105/72.2; 104/247

(58) Field of Classification Search ..... 104/243–249; 105/72.2, 215.1, 215.2
See application file for complete search history.

(56) References Cited

U.S. PATENT DOCUMENTS 3,077,165 A * 2/1963 Vittorelli ..... 104/247
3,921,466 A * 11/1975 Allsup, Jr. ..... 74/110
4,089,272 A * 5/1978 Schmitz ..... 104/247
4,105,086 A * 8/1978 Ishii et al. ..... 180/410
4,183,304 A * 1/1980 Forster ..... 104/247
4,223,611 A * 9/1980 Dawson et al. ..... 104/247
4,265,180 A * 5/1981 Uozumi ..... 104/247

(Continued)

FOREIGN PATENT DOCUMENTS

FR 2639596 A1 6/1990

(Continued)

OTHER PUBLICATIONS

International Search Report for PCT/JP2009/062318 mailed Aug. 25, 2009.

(Continued)

*Primary Examiner* — Jason C Smith

(74) *Attorney, Agent, or Firm* — Lowe Hauptman Ham & Berner LLP

(57) ABSTRACT

The present invention provides a bogie for a guide rail type vehicle running on a predetermined guideway. The bogie of the present invention includes an axle in which steerable running wheels are mounted, a guide frame arranged under the axle, a pair of first guide wheels provided rotatably in a vehicle body end-side part of the guide frame, a pair of second guide wheels provided rotatably in a vehicle body center-side part of the guide frame, a pair of tie rod arms that is attached to the axle and are formed so as to extend from the axle to the vehicle body center-side, and a pair of tie rods each connecting the guide frame to each of the pair of tie rod arms.

5 Claims, 10 Drawing Sheets

U.S. PATENT DOCUMENTS

| | | | | |
|---|---|---|---|---|
| 4,274,338 | A * | 6/1981 | Uozumi | 105/144 |
| 4,299,172 | A * | 11/1981 | Dawson | 104/247 |
| 4,454,819 | A * | 6/1984 | Cuylits et al. | 104/245 |
| 6,029,579 | A * | 2/2000 | Andre et al. | 105/72.2 |
| 6,308,640 | B1 | 10/2001 | Weule et al. | |
| 6,477,963 | B1 * | 11/2002 | Weule et al. | 104/243 |
| 8,074,577 | B2 * | 12/2011 | Morichika et al. | 104/139 |
| 8,161,889 | B2 * | 4/2012 | Morichika et al. | 105/72.2 |
| 2008/0083345 | A1 * | 4/2008 | Morita et al. | 104/106 |
| 2009/0259352 | A1 * | 10/2009 | Morichika et al. | 701/19 |
| 2009/0288575 | A1 * | 11/2009 | Morichika et al. | 104/139 |
| 2010/0036553 | A1 * | 2/2010 | Morichika et al. | 701/19 |
| 2010/0100267 | A1 * | 4/2010 | Morichika et al. | 701/23 |
| 2011/0265683 | A1 * | 11/2011 | Kurahashi et al. | 105/215.2 |
| 2011/0271868 | A1 * | 11/2011 | Kurahashi et al. | 105/141 |
| 2012/0017800 | A1 * | 1/2012 | Kurahashi et al. | 105/182.1 |
| 2012/0031298 | A1 * | 2/2012 | Kurahashi et al. | 105/215.2 |

FOREIGN PATENT DOCUMENTS

| | | | |
|---|---|---|---|
| JP | 45-12884 | | 5/1970 |
| JP | 53-6404 | | 3/1978 |
| JP | 57-125673 | U | 8/1982 |
| JP | 61006061 | A | 1/1986 |
| JP | 1-27492 | Y2 | 8/1989 |
| JP | 2-91070 | U | 7/1990 |
| JP | 11-321635 | A | 11/1999 |
| JP | 2001-48007 | A | 2/2001 |
| JP | 2001-48008 | A | 2/2001 |
| JP | 2001511092 | A | 8/2001 |
| JP | 2006-175962 | A | 7/2006 |
| JP | 2006-205944 | A | 8/2006 |
| JP | 2006-205946 | A | 8/2006 |
| JP | 2006-306334 | A | 11/2006 |
| JP | 2006-347425 | A | 12/2006 |
| JP | 2008-068829 | A | 3/2008 |

OTHER PUBLICATIONS

JP Office Action for 2009-044565 dated Aug. 30, 2011.

A Japanese Office Action, dated May 11, 2012 issued in JP Application No. 2009-044565.

Japanese Notice of Allowance mailed on Sep. 7, 2012, in Japanese Patent Application No. JP 2009-044565, with English translation.

* cited by examiner

BOGIE FOR GUIDE RAIL TYPE VEHICLE

RELATED APPLICATIONS

The present application is a National Phase of International Application Number PCT/JP2009/062318, filed Jul. 6, 2009, and claims priority from, Japanese Application Number 2009-044565, filed Feb. 26, 2009.

TECHNICAL FIELD

The present invention relates to a guide rail type vehicle running on a predetermined guideway. More particularly, the present invention relates to a bogie for a guide rail type vehicle, which is configured so as to be steered by being guided by a guide rail provided on a guideway.

BACKGROUND ART

Conventionally, there has been proposed a bogie for a guide rail type vehicle, which is configured so as to run along a guide rail provided on a guideway by providing a steering mechanism using guide wheels (for example, see Patent Documents 1 and 2).

FIG. 10 is a plan view of a bogie on the front side in the vehicle longitudinal direction of a guide rail type vehicle, showing one example of a conventional bogie for a guide rail type vehicle.

As shown in FIG. 10, a bogie 52 for a guide rail type vehicle 51, which runs along a guide rail 53 provided on a guideway, has a guide frame 54 formed into a rectangular shape in plan view. To a vehicle body end-side part 54*a* of the guide frame 54, a pair of guide wheels 55 is attached rotatably. On the other hand, to a vehicle body center-side part 54*b* of the guide frame 54 as well, a pair of guide Wheels 56 is attached rotatably. These guide wheels 55 and 56 are configured so as to rotate while being in contact with the side faces of the guide rail 53.

Also, the bogie 52 has a pair of right and left running wheels 57. The running wheel 57 on the left-hand side with respect to the vehicle running direction is provided with a steering lever 58 extending from the running wheel 57 to the end side of the vehicle body and a first link lever 59 extending from the running wheel 57 to the center side of the vehicle body. An end part 58*a*, on the center side of the vehicle body, of the steering lever 58 and an end part 59*a*, on the end side of the vehicle body, of the first link lever 59 are connected to the running wheel 57 via a rotation shaft 60.

On the other hand, the running wheel 57 on the right-band side with respect to the vehicle running direction is provided with a second link lever 61 extending from the running wheel 57 to the center side of the vehicle body. An end part 61*a*, on the end side of the vehicle body, of the second link lever 61 is connected to the running wheel 57 via a rotation shaft 62. Also, an end part 59*b*, on the center side of the vehicle body, of the first link lever 59 and an end part 61*b*, on the center side of the vehicle body, of the second link lever 61 are connected to each other by a tie rod 63 extending in the lateral direction of the vehicle body.

The guide frame 54 of the bogie 52 is provided with an actuator 64. The actuator 64 is connected to an end part 58*b*, on the end side of the vehicle body, of the steering lever 58 via a steering rod 65.

Because of the above-described configuration, for the conventional bogie 52, by changing the distance L from the center of the guide frame 54 to the connection position between the actuator 64 and the steering rod 65 by using the actuator 64, the pair of right and left running wheels 57 is steered beyond the turn angle of the guide frame 54.

PRIOR ART DOCUMENTS

Patent Documents

Patent Document 1: U.S. Pat. No. 6,477,963

Patent Document 2: Japanese Unexamined Patent Application Publication No. 11-321635

DISCLOSURE OF THE INVENTION

Problems to be Solved by the Invention

Unfortunately, for the above-described conventional configuration, a problem as described below arises when the bogie 52 runs in a curved portion of the guide rail 53.

Explanation is given by taking the running wheel 57 on the left-hand side with respect to the running direction as an example. Even if the radius of curvature of the curved section of the guide rail 53 is the same, in the case of right curve, the running Wheel 57 on the left-hand side is positioned on the outside of the curve, and in the case of left curve, the running Wheel 57 on the left-hand side is positioned on the inside of the curve. If the actuator 64 carries out similar control in the cases of both the right and left curves, the running wheel 57 on the left-hand side is steered in the same manner even when it is present on the inside of the curve or on the outside thereof. That is, if the actuator 64 carries out similar control in the cases of both the right and left curves, the steering angle of the running wheel 57 positioned on the inside of the curve and the steering angle of the running wheel 57 positioned on the outside thereof are not the same in the cases of both the right and left curves. As a result, the tire and the like of the running wheel 57 may wear unevenly.

Further, for the above-described conventional configuration, the actuator 64 controls only the steering rod 65 connected to the running wheel 57 on the left-hand side. In order to control the running wheel 57 on the right-hand side in the same way, the pair of right and left running wheels 57 must be connected to each other by the tie rod 63. Therefore, a large space must be required on the bogie 52 because of the structure.

The present invention has been made in view of the above circumstances, and accordingly an object thereof is to provide a bogie for a guide rail type vehicle, which can make the steering angles of running wheels the same in the cases of both right and left curves, and has a compact configuration as compared with the conventional example.

Means for Solving the Problems

To solve the problems with the above-described prior art, according to an embodiment of the present invention, in a bogie for a guide rail type vehicle configured so as to be steered by being guided by a guide rail provided on a predetermined guideway when running on the guideway, the bogie includes an axle in which a pair of running wheels is steerably mounted at both ends of the axle; a guide frame that is arranged under the axle, is attached turnably to the axle via a bearing, and is formed so as to extend in the vehicle longitudinal direction; a pair of first guide wheels that is arranged adjacently to each other in the vehicle lateral direction so as to be in contact with the guide rail, and is provided rotatably in the vehicle body end-side part in the vehicle longitudinal direction of the guide frame; a pair of second guide wheels that is arranged adjacently to each other in the vehicle lateral direction so as to be in contact with the guide rail, and is provided rotatably in the vehicle body center-side part in the vehicle longitudinal direction of the guide frame; a pair of tie rod arms that is arranged so as to be opposed to each other with the guide rail being held therebetween, is attached to the axle, and is formed so as to extend from the axle to the vehicle body center-side; and a pair of tie rods each connecting the guide frame to each of the pair of tie rod arms, the pair of tie rods being configured so that one end of each of the tie rods is attached rotatably to the tie rod arm, and the other end of each of the tie rods is attached rotatably to the guide frame.

According to another embodiment of the present invention, the bogie further includes a turning damper that is arranged so as to connect between the guide frame and the axle, and is configured so as to restrain the turning operation of the guide frame; and a restoring rod that is arranged so as to connect between the guide frame and the axle, and is configured so as to restore the guide frame to a straight movement state after the turning operation of the guide frame.

According to still another embodiment of the present invention, the center axis of the axle is arranged so as to be offset to the vehicle body center side in the vehicle longitudinal direction with respect to the turning center axis of the guide frame.

Also, according to still another embodiment of the present invention, the bogie further includes a pair of first guide wheel supports which is tunably provided in the vehicle body end-side part of the guide frame, and a pair of second guide wheel supports which is turnably provided in the vehicle body center-side part of the guide frame. The pair of first guide wheel supports is arranged so as to be opposed to each other in the axle direction, each of the pair of first guide wheels is attached to the vehicle body end-side part of the guide frame via each of the pair of first guide wheel supports, and the pair of first guide wheels is connected to each other by a shock-absorbing rod. The pair of second guide wheel supports is arranged so as to be opposed to each other in the axle direction, each of the pair of second guide wheels is attached to the vehicle body center-side part of the guide frame via each of the pair of second guide wheel supports, and the pair of second guide wheels is connected to each other by a shock-absorbing rod.

Further, according to still another embodiment of the present invention, the bogie further includes a first guide wheel supporting member which connects the pair of first guide wheels to each other; a pair of first leaf springs which is provided in the vehicle body end-side part of the guide frame, and is arranged so as to be opposed to each other in the axle direction, the first guide wheel supporting member being attached to the vehicle body end-side part of the guide frame via the pair of first leaf springs; a second guide wheel supporting member which connects the pair of second guide wheels to each other; and a pair of second leaf springs which is provided in the vehicle body center-side part of the guide frame, and is arranged so as to be opposed to each other in the axle direction, the second guide wheel supporting member being attached to the vehicle body center-side part of the guide frame via the pair of second leaf springs.

Still further, according to still another embodiment of the present invention, the bogie further includes a first link which connects the pair of first guide wheels to each other, and is arranged so as to tilt with respect to the guide rail; a first link support which is provided in the vehicle body end-side part of the guide frame, the first link support extending to the vehicle end side in the vehicle longitudinal direction, and the first link being attached rotatably to the first link support via a first shock-absorbing mechanism having a restoring function; a second link which connects the pair of second guide wheels to each other, and is arranged so as to tilt with respect to the guide rail; and a second link support which is provided in the vehicle body center-side part of the guide frame, the second link support extending to the vehicle body center-side in the vehicle longitudinal direction, and the second link being attached rotatably to the second link support via a second shock-absorbing mechanism having a restoring function.

Advantages of the Invention

According to the bogie for a guide rail type vehicle in accordance with the present invention, in the bogie for the guide rail type vehicle configured so as to be steered by being guided by the guide rail provided on the predetermined guideway when running on the guideway, the bogie includes the axle in which a pair of running wheels is steerably mounted at both ends of the axle; the guide frame that is arranged under the axle, is attached turnably to the axle via the bearing, and is formed so as to extend in the vehicle longitudinal direction; the pair of first guide wheels that is arranged adjacently to each other in the vehicle lateral direction so as to be in contact with the guide rail, and is provided rotatably in the vehicle body end-side part in the vehicle longitudinal direction of the guide frame; the pair of second guide wheels that is arranged adjacently to each other in the vehicle width direction so as to be in contact with the guide rail, and is provided rotatably in the vehicle body center-side part in the vehicle longitudinal direction of the guide frame; the pair of tie rod arms that is arranged so as to be opposed to each other with the guide rail being held therebetween, is attached to the axle, and is formed so as to extend from the axle to the vehicle body center-side; and the pair of tie rods each connecting the guide frame to each of the pair of tie rod arms, the pair of tie rods being configured so that one end of each of the tie rods is attached rotatably to the tie rod arm, and the other end of each of the tie rods is attached rotatably to the guide frame. Therefore, when the bogie passes through a curved section of the guide rail, the axle and the guide frame are turned in association with each other via the pair of tie rods and the pair of tie rod arms. Thereby, even in the case in which the guide rail is curved either to the right or to the left, the axle and the guide frame are turned in the same manner, so that the steering angles of the running wheels become the same. Therefore, the tire can be prevented from wearing unevenly.

Also, a large tie rod that connects the pair of running wheels to each other as in the conventional example need not be provided, and the tie rod has only to be formed so as to have a size such that the tie rod arm is connected to the guide frame. Therefore, a space required on the bogie is small compared with the conventional example. As a result, the bogie can be made compact in size. In addition, unlike the conventional example, an actuator or a steering rod need not be provided on the bogie, so that the structure of the bogie becomes simple.

Also, according to the bogie for a guide rail type vehicle in accordance with the present invention, the bogie further includes the turning damper that is arranged so as to connect the guide frame and the axle to each other, and is configured so as to restrain the turning operation of the guide frame; and the restoring rod that is arranged so as to connect the guide frame and the axle to each other, and is configured so as to restore the guide frame to the straight running state after the turning operation of the guide frame. Therefore, when the bogie passes through a curved section of the guide rail, sudden turning of the axle and the guide frame is restrained by the turning damper. As a result, vibrations occurring when the bogie passes through the curved section of the guide rail can be prevented. In addition, after the bogie has passed through the curved section of the guide rail, the guide frame is immediately restored to the straight running state by the restoring rod. Therefore, the bogie can run stably in a section in which the guide rail changes from a curved line to a straight line.

Also, according to the bogie for a guide rail type vehicle in accordance with the present invention, the center axis of the axle is arranged so as to be offset to the vehicle body center side in the vehicle longitudinal direction with respect to the turning center axis of the guide frame. Therefore, for example, when the bogie on the front side of the vehicle passes through a curved section of the guide rail, the running wheel turns toward the inside of the curve through a predetermined angle (slip angle) with respect to the curve tangential direction at the position of the running wheel. Thereby, a cornering force is generated on the tire of the running wheel toward the inside of the curve. That is, when the bogie on the front side passes through the curved section of the guide rail, the cornering force in the direction reverse to the centrifugal force acting on the bogie is generated, so that the loads applied to the first and second guide wheels are low. As a result, the service lives of the first and second guide wheels can be prolonged.

In addition, for example, in the case of the bogie on the front side, the distance from the first guide wheel on the front side to the axle center is longer than the distance from the second guide wheel on the rear side to the axle center. Therefore, the load applied to the first guide wheel is low because of the leverage. As a result, the service life of the first guide wheel can be made longer.

Also, for example, in the case of the bogie on the front side, the turning center axis of the guide frame is arranged in front of the center position of the axle. Therefore, the guide frame is guided by the guide rail somewhat prior to the axle, and thereby a trailing effect such that the axle follows the guide frame so that steering can be performed easily is produced, which improves the running stability of the bogie.

Also, according to the bogie for a guide rail type vehicle in accordance with the present invention, the bogie further includes the pair of first guide wheel supports which is turnably provided in the vehicle body end-side part of the guide frame, the pair of first guide wheel supports being arranged so as to be opposed to each other in the axle direction, each of the pair of first guide wheels being attached to the vehicle body end-side part of the guide frame via each of the pair of first guide wheel supports, and the pair of first guide wheels being connected to each other by the shock-absorbing rod; and the pair of second guide wheel supports which is turnably provided in the vehicle body center-side part of the guide frame, the pair of second guide wheel supports being arranged so as to be opposed to each other in the axle direction, each of the pair of second guide wheels being attached to the vehicle body center-side part of the guide frame via each of the pair of second guide wheel supports, and the pair of second guide wheels being connected to each other by the shock-absorbing rod. Therefore, when the bogie runs in a curved section of the guide rail or on a joint etc. of the guide rail, shocks received by the first and second guide wheels are absorbed by the shock-absorbing rods, and the shocks are restrained from being transmitted to the guide frame and the bogie. Thereby, the running stability of the bogie is improved, so that the riding comfort of passengers in the vehicle can be improved. Also, since the shocks applied to the first and second guide wheels themselves are decreased by the shock-absorbing rods, the lives of the first and second guide wheels can be prolonged.

Also, according to the bogie for a guide rail type vehicle in accordance with the present invention, the bogie further includes the first guide wheel supporting member which connects the pair of first guide wheels to each other; the pair of first leaf springs which is provided in the vehicle body end-side part of the guide frame, and is arranged so as to be opposed to each other in the axle direction, the first guide wheel supporting member being attached to the vehicle body end-side part of the guide frame via the pair of first leaf springs; the second guide wheel supporting member which connects the pair of second guide wheels to each other; and the pair of second leaf springs which is provided in the vehicle body center-side part of the guide frame, and is arranged so as to be opposed to each other in the axle direction, the second guide wheel supporting member being attached to the vehicle body center-side part of the guide frame via the pair of second leaf springs. Therefore, when the bogie runs in a curved section of the guide rail or on a joint etc. of the guide rail, shocks received by the first and second guide wheels are absorbed by the first and second leaf springs, respectively, and the shocks are restrained from being transmitted to the guide frame and the bogie. Thereby, the running stability of the bogie is improved, so that the riding comfort of passengers in the vehicle can be improved. Also, since the shocks applied to the first and second guide wheels themselves are decreased by the first and second leaf springs, respectively, the lives of the first and second guide wheels can be prolonged.

Further, since the leaf springs, which are not worn-out parts, are used to connect the first and second split-type guide wheel supporting members to the guide frame, the replacement cycle becomes longer, and the maintainability is also improved.

Also, according to the bogie for a guide rail type vehicle in accordance with the present invention, the bogie further includes the first link which connects the pair of first guide wheels to each other, and is arranged so as to tilt with respect to the guide rail; the first link support which is provided in the vehicle body end-side part of the guide frame, the first link support extending to the vehicle end side in the vehicle longitudinal direction, and the first link being attached rotatably to the first link support via the first shock-absorbing mechanism having the restoring function; the second link which connects the pair of second guide wheels to each other, and is arranged so as to tilt with respect to the guide rail; and the second link support which is provided in the vehicle body center-side part of the guide frame, the second link support extending to the vehicle body center-side in the vehicle longitudinal direction, and the second link being attached rotatably to the second link support via the second shock-absorbing mechanism having the restoring function. Therefore, when the bogie runs in a curved section of the guide rail or on a joint etc. of the guide rail, shocks received by the first and second guide wheels are absorbed by the turning of the first and second links, respectively, and the shocks are restrained from being transmitted to the guide frame and the bogie. Thereby, the running stability of the bogie is improved, so that the riding comfort of passenger on the vehicle can also be improved. Also, since the shocks applied to the first and second guide wheels themselves are decreased by the turning of the first and second links, respectively, the lives of the first and second guide wheels can be prolonged.

BEST MODE FOR CARRYING OUT THE INVENTION

First Embodiment

Figure 1:
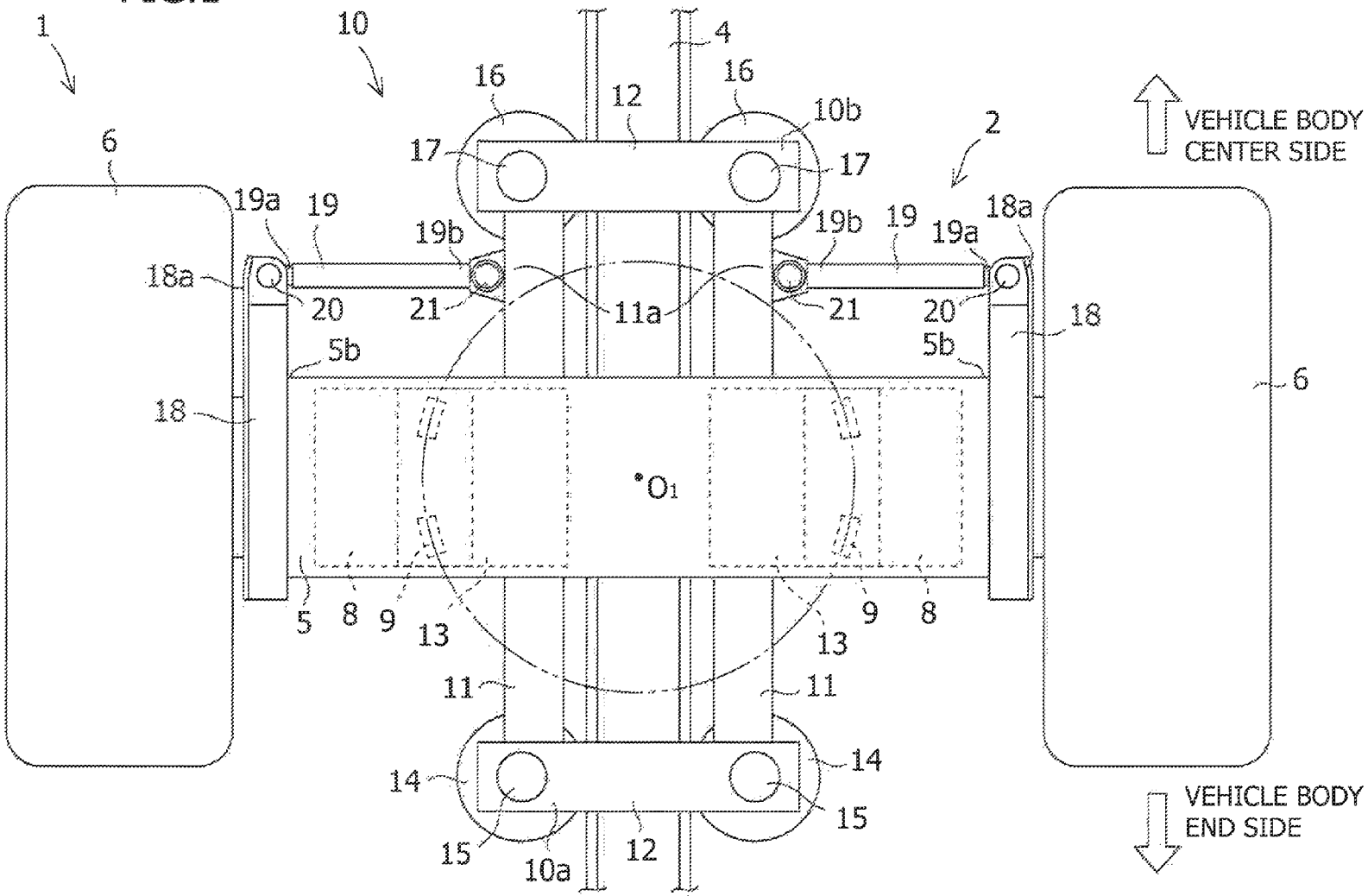
FIG. 1 is a plan view of a bogie on the front side in the vehicle longitudinal direction of a guide rail type vehicle in accordance with a first embodiment of the present invention.
Figure 2:
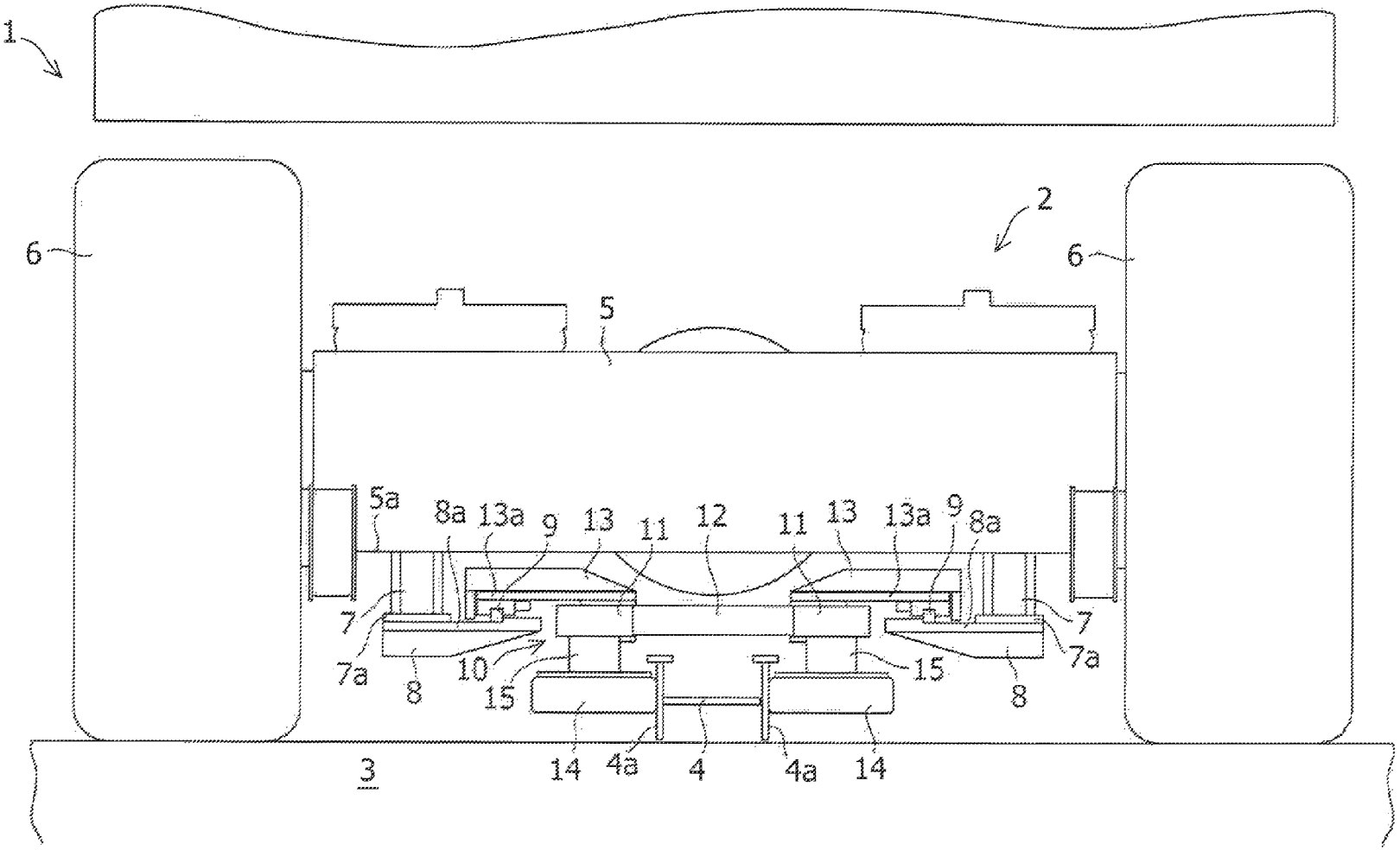
FIG. 2 is a front view of the bogie shown in FIG. 1, being viewed from the vehicle body end-side.

A bogie for a guide rail type vehicle in accordance with a first embodiment of the present invention will now be described with reference to the accompanying drawings. FIG. 1 is a plan view of a bogie on the front side in the vehicle longitudinal direction of the guide rail type vehicle in accordance with the first embodiment of the present invention. FIG. 2 is a front view of the bogie shown in FIG. 1, being viewed from the vehicle body end-side.

As shown in FIGS. 1 and 2, a vehicle 1 includes bogies 2 in the front and rear sides (the rear side is not shown) in the vehicle longitudinal direction, and runs on a predetermined guideway 3. In a substantially central portion in the vehicle lateral direction of the guideway 3, a guide rail 4 having an H-shaped cross section is laid.

As shown in FIGS. 1 and 2, the bogie 2 includes an axle 5 extending in the vehicle lateral direction. To both the ends in the vehicle lateral direction of the axle 5, a pair of running wheels 6 is steerably attached. Also, on a lower surface 5*a* of the axle 5, a pair of supports 7 is provided at positions opposed with the guide rail 4 being held therebetween. In addition, at a lower end 7*a* of each of the supports 7, a plate-shaped frame 8 extending toward the vehicle center side is provided. On an upper surface 8*a* of the frame 8, arc-shaped bearings 9 (for example, R guides) are arranged.

As shown in FIGS. 1 and 2, between the guide rail 4 and the axle 5, a guide frame 10 is provided. The guide frame 10 is formed into a rectangular shape in plan view, and is configured by two longitudinal frames 11 extending in the vehicle longitudinal direction and two transverse frames 12 connecting both the end portions in the vehicle longitudinal direction of the two longitudinal frames 11 to each other. Each of the longitudinal frames 11 is provided with a bearing holding member 13 extending toward the vehicle outside at a position corresponding to the axle 5, and a lower surface 13*a* of the bearing holding member 13 holds the bearings 9 on the frame 8. Thereby, the guide frame 10 can be turned along a two-dot chain line (refer to FIG. 1) with respect to the axle 5 with the guide frame center $O_1$ being the center of rotation.

As shown in FIGS. 1 and 2, a pair of first guide wheels 14 is provided in a vehicle body end-side part 10*a* in the vehicle longitudinal direction of the guide frame 10. The pair of first guide wheels 14 is arranged so as to be opposed to each other with the guide rail 4 being held therebetween. Each of the first guide wheels 14 is arranged transversely so as to be in contact with an outside side surface 4*a* of the guide rail 4, and the central portion thereof is attached rotatably to the guide frame 10 via a rotation shaft 15.

Also, a pair of second guide wheels 16 is provided in a vehicle body center-side part 10*b* in the vehicle longitudinal direction of the guide frame 10. The pair of second guide wheels 16 is arranged so as to be opposed to each other with the guide rail 4 being held therebetween. Each of the second guide wheels 16 is arranged transversely so as to be in contact with the outside side surface 4*a* of the guide rail 4, and the central portion thereof is attached rotatably to the guide frame 10 via a rotation shaft 17.

In this embodiment, as shown in FIG. 1, a pair of tie rod arms 18 is provided in running wheel nearby parts 5*b* of the axle S. The pair of tie rod arms 18 is formed so as to extend to the vehicle body center-side. A vehicle body center-side end part 18*a* of each of the tie rod arms 18 and a vehicle body center-side part 11*a* of the longitudinal frame 11 of the guide frame 10 are connected to each other by one of a pair of tie rods 19 formed so as to extend in the vehicle lateral direction. A vehicle outside end part 19*a* of each of the tie rods 19 is attached rotatably to the vehicle body center-side end part 18*a* of the tie rod arm 18 via a joint 20. Also, a vehicle center side end part 19*b* of each of the tie rods 19 is attached rotatably to the vehicle body center-side part 11*a* of the longitudinal frame 11 of the guide frame 10 via a joint 21.

Although not shown in the figures, in this embodiment, a bogie on the rear side of the vehicle 1 has the same configuration as that of the above-described embodiment.

According to the bogie for a guide rail type vehicle in accordance with this embodiment, the bogie 2 includes the axle 5 in which the pair of running wheels 6 is steerably mounted at both ends of the axle 5, the guide frame 10 that is attached turnably to the frames 8 of the axle 5 via the bearings 9 and is formed so as to extend in the vehicle longitudinal direction, the pair of first guide wheels 14 provided rotatably in the vehicle body end-side part 10*a* of the guide frame 10, the pair of second guide wheels 16 provided rotatably in the vehicle body center-side part 10*b* of the guide frame 10, the pair of tie rod arms 18 that is attached to the axle 5 and is formed so as to extend from the axle 5 to the vehicle body center-side, and the pair of tie rods 19 each connecting the vehicle body center-side part 11*a* of the longitudinal frame 11 of the guide frame 10 to the vehicle body center-side end part 18*a* of each of the pair of tie rod arms 18, the pair of tie rods 19 being configured so that the vehicle outside end part 19*a* of each of the tie rods 19 is attached rotatably to the tie rod arm 18, and the vehicle inside end part 19*b* of each of the tie rods 19 is attached rotatably to the guide frame 10. Therefore, when the bogie 2 passes through a curved section of the guide rail 4, the axle 5 and the guide frame 10 are turned in association with each other via the pair of tie rods 19 and the pair of tie rod arms 18. Thereby, even in the case in which the guide rail 4 is curved either to the right or to the left, the axle 5 and the guide frame 10 are turned in the same manner, so that the steering angles of the running wheels 6 become the same. Therefore, the tire and the like of the running wheel 6 can be prevented from wearing unevenly.

Also, a large tie rod that connects the pair of running wheels to each other as in the conventional example need not be provided, and the tie rod 19 has only to be formed so as to have a size such that the tie rod arm 18 is connected to the guide frame 10. Therefore, a space required on the bogie 2 becomes small as compared with the conventional example. As a result, the bogie 2 can be made compact in size.

Further, unlike the conventional example, an actuator or a steering rod need not be provided on the bogie 2, so that the structure of the bogie 2 becomes simpler. Also, by using an R guide as the bearing 9, the structure of the bogie 2 is made more compact.

Second Embodiment

Figure 3:
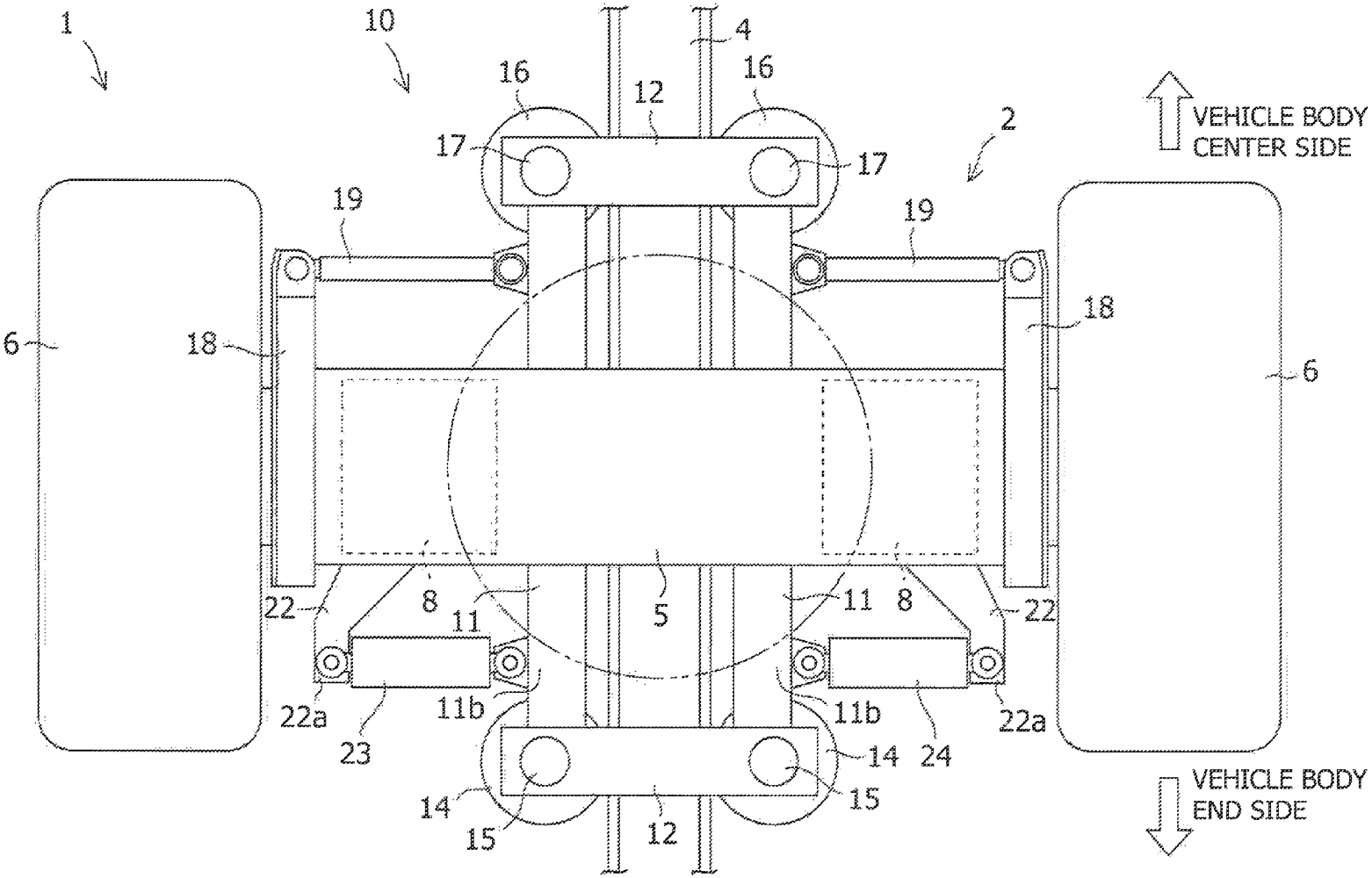
FIG. 3 is a plan view of a bogie on the front side in the vehicle longitudinal direction of a guide rail type vehicle in accordance with a second embodiment of the present invention.

A bogie for a guide rail type vehicle in accordance with a second embodiment of the present invention will now be described with reference to the accompanying drawings. FIG. 3 is a plan view of a bogie on the front side in the vehicle longitudinal direction of a guide rail type vehicle in accordance with the second embodiment of the present invention. In this embodiment, the same symbols are applied to elements that are the same as those explained in the above-described embodiment, and repeated explanation thereof is omitted.

In this embodiment, as shown in FIG. 3, each of the frames 8 of the axle 5 is provided with a pair of arms 22. The pair of arms is formed so as to extend to the vehicle body end-side. An end part 22*a* on the vehicle body end-side of the arm 22 on the right-hand side with respect to the vehicle running direction and a vehicle body end-side part 11*b* of the longitudinal frame 11 of the guide frame 10 are connected to each other by a turning damper 23 extending in the vehicle lateral direction, and the turning damper 23 is configured so as to restrain a sudden turning operation of the guide frame 10 when the vehicle 1 passes through a curved section (not shown) of the guide rail 4.

Also, the end part 22*a* on the vehicle body end-side of the arm 22 on the left-hand side with respect to the vehicle running direction and the vehicle body end-side part 11*b* of the longitudinal frame 11 of the guide frame 10 are connected to each other by a restoring rod 24 extending in the vehicle lateral direction. The restoring rod 24 is configured so as to restore the guide frame 10 to a straight running state after the turning operation of the guide frame 10 (after the vehicle 1 has passed through a curved section of the guide rail 4).

Although not shown in the figures, in this embodiment, a bogie on the rear side of the vehicle 1 has the same configuration as that of the above-described embodiment.

Thus, according to the bogie for a guide rail type vehicle in accordance with this embodiment, the bogie includes the turning damper 23 that is arranged so as to connect between the vehicle body end-side part 11*b* of the longitudinal frame 11 of the guide frame 10 and the arm 22 provided on the frame 8 of the axle 5 and is configured so as to restrain the turning operation of the guide frame 10, and the restoring rod 24 that is arranged so as to connect between the vehicle body end-side part 11*b* of the longitudinal frame 11 of the guide frame 10 and the arm 22 provided on the frame 8 of the axle 5 and is configured so as to restore the guide frame 10 to a straight running state after the turning operation of the guide frame 10. Therefore, when the bogie 2 passes through a curved section of the guide rail 4, sudden turning of the axle 5 and the guide frame 10 is restrained by the turning damper 23. As a result, vibrations occurring when the bogie 2 passes through the curved section of the guide rail 4 can be prevented. In addition, after the bogie 2 has passed through the curved section of the guide rail 4, the guide frame 10 is immediately restored to the straight running state by the restoring rod 24. Therefore, the bogie 2 can run stably in a section in which the guide rail 4 changes from a curved line to a straight line.

Third Embodiment

Figure 4:
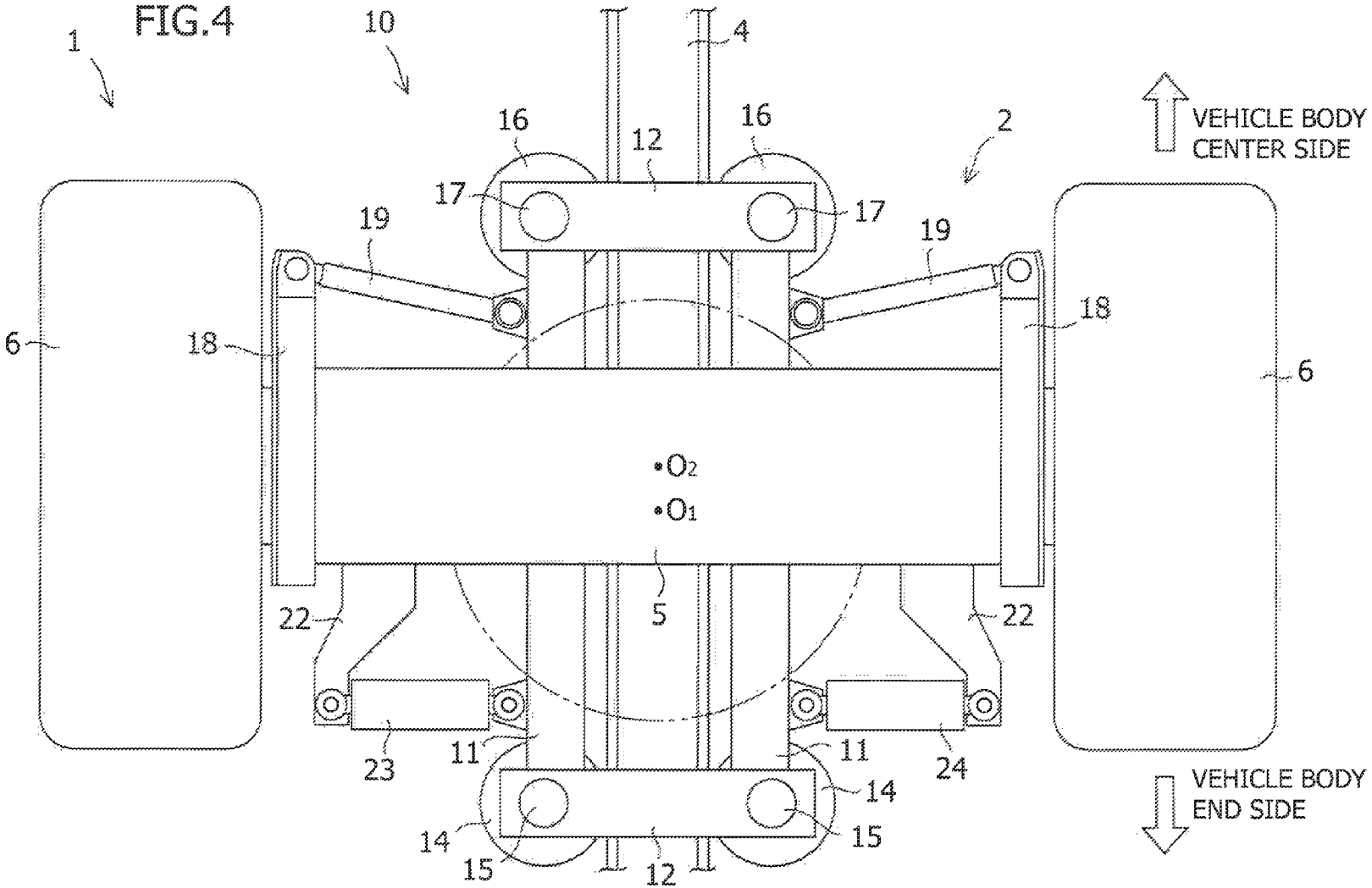
FIG. 4 is a plan view of a bogie on the front side in the vehicle longitudinal direction of a guide rail type vehicle in accordance with a third embodiment of the present invention.

A bogie for a guide rail type vehicle in accordance with a third embodiment of the present invention will now be described with reference to the accompanying drawings. FIG. 4 is a plan view of a bogie on the front side in the vehicle longitudinal direction of a guide rail type vehicle in accordance with the third embodiment of the present invention. In this embodiment, the same symbols are applied to elements that are the same as those explained in the above-described embodiments, and repeated explanation thereof is omitted.

In this embodiment, as shown in FIG. 4, the center axis $O_2$ of the axle 5 is arranged so as to be offset to the vehicle body center-side in the vehicle longitudinal direction with respect to the guide frame center $O_1$ (the turning center of guide frame). Although not shown in the figures, in this embodiment, a bogie on the rear side of the vehicle 1 has the same configuration as that of the above-described embodiment.

Figure 5:
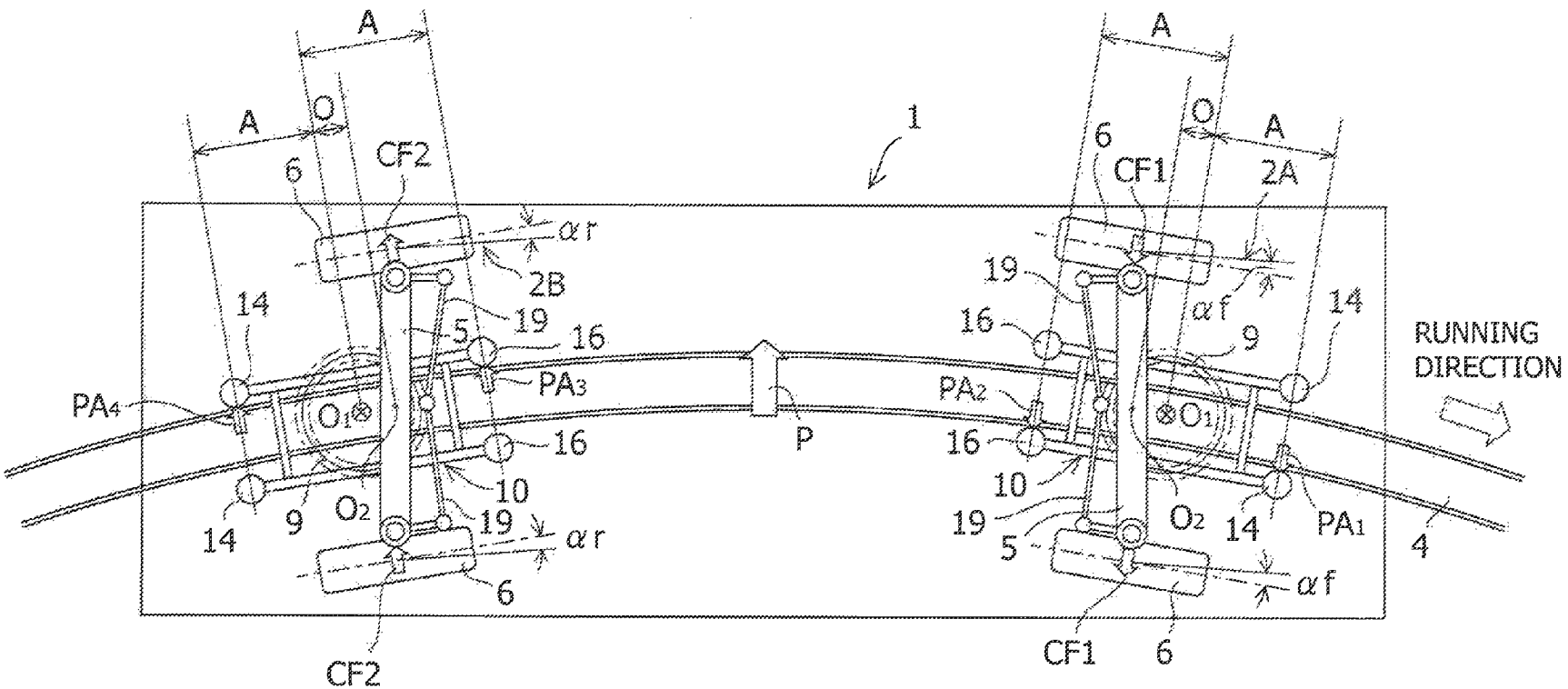
FIG. 5 is a plan view showing a state of bogies at the time when a guide rail type vehicle in accordance with a third embodiment of the present invention passes through a curved section of a guide rail.

Next, a force applied to the bogie when the bogie for a guide rail type vehicle in accordance with this embodiment passes through a curved section of the guide rail is explained. FIG. 5 is a plan view showing a state of front and rear bogies 2A and 2B of the vehicle 1 at the time when the vehicle 1 in accordance with this embodiment passes through the curved section of the guide rail 4.

As shown in FIG. 5, A is the distance from the guide frame center $O_1$ to the guide wheel 14, 16, O is the distance from the center axis $O_2$ of the axle 5 to the guide frame center $O_1$, and P is the surplus centrifugal load at the time when the vehicle 1 passes through the curved section of the guide rail 4. Also, CF1 is the cornering force acting on the running wheel 6 of the bogie 2A on the front side, and CF2 is the cornering force acting on the running wheel 6 of the bogie 2B on the rear side. Symbol of denotes the slip angle of the running wheel 6 of the bogie 2A on the front side, and symbol αr denotes the slip angle of the running wheel 6 of the bogie 2B on the front side.

The load $PA_1$ acting on the first guide wheel 14 of the bogie 2A on the front side is expressed by the following formula:

$$PA_1=(\text{guide load on front side})+(P/4)-(2\times CF1\times(A-O)/2A)$$

Also, the load $PA_2$ acting on the second guide wheel 16 of the bogie 2A on the front side is expressed by the following formula:

$$PA_2=(\text{guide load on rear side})+(P/4)-(2\times CF1\times(A+O)/2A)$$

in which the guide load is a load necessary for steering the tire against restoring forces.

The load $PA_3$ acting on the second guide wheel 16 of the bogie 2B on the rear side is expressed by the following formula:

$$PA_3=(\text{guide load on front side})-(P/4)-(2\times CF2\times(A+O)/2A)$$

Also, the load $PA_4$ acting on the first guide wheel 14 of the bogie 2B on the rear side is expressed by the following formula:

$$PA_4=(\text{guide load on rear side})-(P/4)-(2\times CF2\times(A-O)/2A)$$

in which the guide load is a load necessary for steering the tire against restoring forces.

Thus, according to the bogie for a guide rail type vehicle in accordance with this embodiment, the center axis $O_2$ of the axle 5 is arranged so as to be offset to the vehicle body center-side in the vehicle longitudinal direction with respect to the guide frame center $O_1$ (the turning center of guide frame). Therefore, for example, when the bogie 2A on the front side of the vehicle 1 passes through a curved section of the guide rail 4, the running wheel 6 turns toward the inside of the curve through a predetermined angle (slip angle) $\alpha f$ with respect to the curve tangential direction at the position of the running wheel 6. Thereby, a cornering force CF1 is generated on the tire of the running wheel 6 toward the inside of the curve. That is, when the bogie 2A on the front side passes through the curved section of the guide rail 4, the cornering force CF1 in the direction reverse to the centrifugal force P acting on the bogie 2A is generated, so that the loads applied to the first and second guide wheels 14 and 16 become low. As a result, the service lives of the first and second guide wheels 14 and 16 can be prolonged.

In addition, for example, in the case of the bogie 2A on the front side, the distance from the first guide wheel 14 on the front side to the center axis $O_2$ of the axle 5 is longer than the distance from the second guide wheel 16 on the rear side to the center axis $O_2$ of the axle 5. Therefore, the load applied to the first guide wheel 14 is low because of the leverage. As a result, the service life of the first guide wheel 14 can be made longer.

Also, for example, in the case of the bogie 2A on the front side, the turning center axis $O_1$ of the guide frame 10 is arranged in front of the center axis $O_2$ of the axle 5. Therefore, the guide frame 10 is guided by the guide rail 4 somewhat prior to the axle 5, and thereby a trailing effect such that the axle 5 follows the guide frame 10 so that steering can be performed easily is produced, which improves the running stability of the bogie 2A.

Fourth Embodiment

Figure 6:
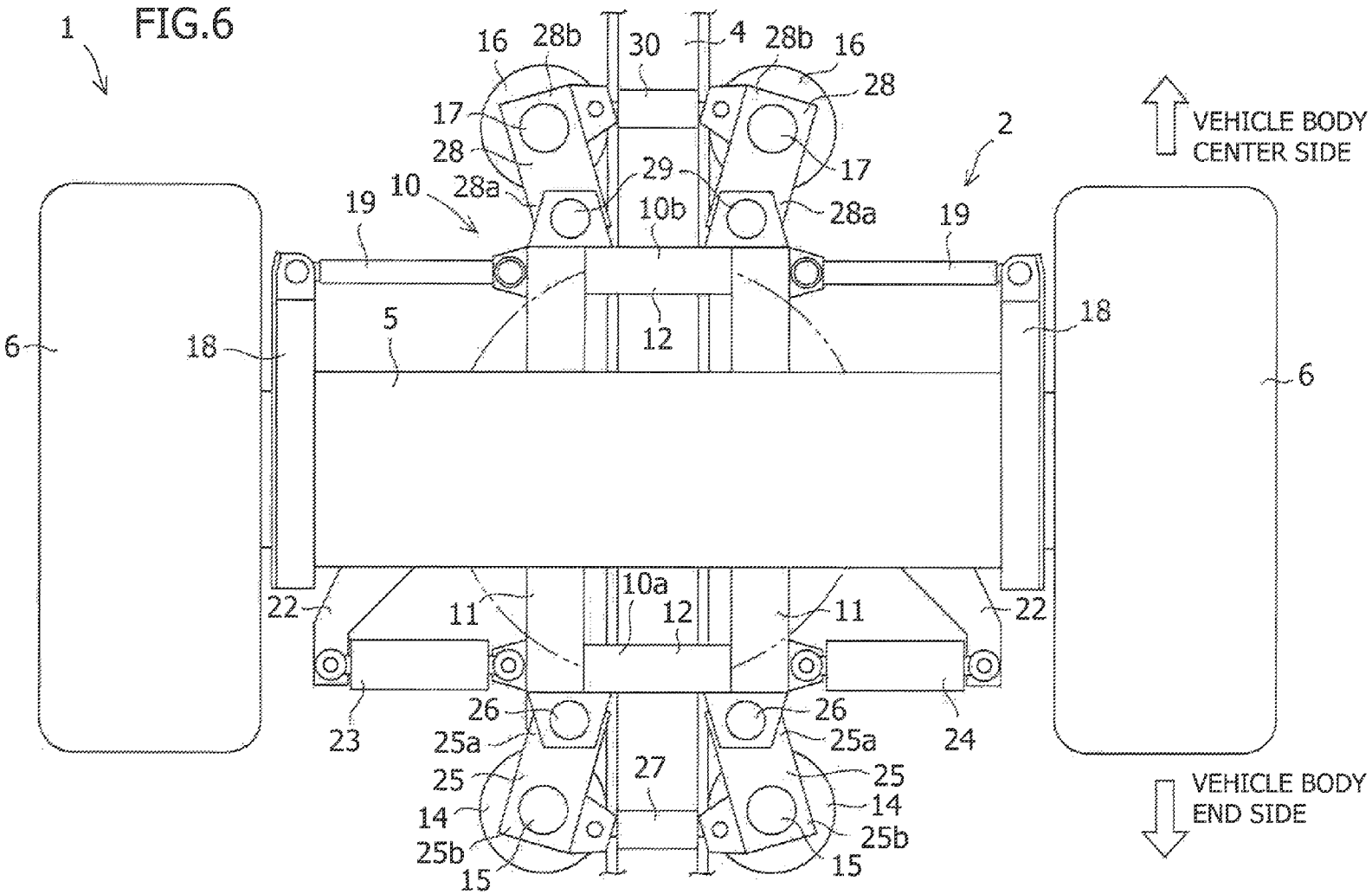
FIG. 6 is a plan view of a bogie on the front side in the vehicle longitudinal direction of a guide rail type vehicle in accordance with a fourth embodiment of the present invention.

A bogie for a guide rail type vehicle in accordance with a fourth embodiment of the present invention will now be described with reference to the accompanying drawings. FIG. 6 is a plan view of a bogie on the front side in the vehicle longitudinal direction of a guide rail type vehicle in accordance with the fourth embodiment of the present invention. In this embodiment, the same symbols are applied to elements that are the same as those explained in the above-described embodiments, and repeated explanation thereof is omitted.

In this embodiment, as shown in FIG. 6, a pair of first guide wheel supports 25 is provided in the vehicle body end-side part 10*a* of the guide frame 10. The pair of first guide wheel supports 25 is arranged so as to be opposed to each other with the guide rail 4 being held therebetween. Each of the first guide wheel supports 25 is arranged so as to extend to the vehicle body end-side in the vehicle longitudinal direction. A vehicle body center-side part 25*a* of the first guide wheel support 25 is attached rotatably to the guide frame 10 via a rotation shaft 26. Also, to a vehicle body end-side part 25*b* of the first guide wheel support 25, the first guide wheel 14 is attached rotatably via the rotation shaft 15.

In this embodiment, as shown in FIG. 6, the vehicle body end-side parts 25*b* of the pair of first guide wheel supports 25 is connected to each other by a shock-absorbing rod 27 extending in the vehicle lateral direction. The shock-absorbing rod 27 is provided with a stopper (not shown) so that the first guide wheel supports 25 do not turn toward the vehicle body center side, and therefore the space between the first guide wheel supports 25 is not narrowed. That is, the shock-absorbing rod 27 is subjected to only the force in the vehicle body outside direction, which is received from the first guide wheels 14, so that the space between the first guide wheel supports 25 is widened when the force acts.

Also, in this embodiment, as shown in FIG. 6, a pair of second guide wheel supports 28 is provided in the vehicle body center-side part 10*b* of the guide frame 10. The pair of second guide wheel supports 28 is arranged so as to be opposed to each other with the guide rail 4 being held therebetween. Each of the second guide wheel supports 28 is arranged so as to extend to the vehicle body center-side in the vehicle longitudinal direction, and a vehicle body end-side part 28*a* of the second guide wheel support 28 is attached rotatably to the guide frame 10 via a rotation shaft 29. Also, to a vehicle body center-side part 28*b* of the second guide wheel support 28, the second guide wheel 16 is attached rotatable via the rotation shaft 17.

Also, in this embodiment, as shown in FIG. 6, the vehicle body end-center parts 28*b* of the pair of second guide wheel supports 28 are connected to each other by a shock-absorbing rod 30 extending in the vehicle lateral direction. The shock-absorbing rod 30 is provided with a stopper (not shown) so that the second guide wheel supports 28 do not turn toward the vehicle body center side, and therefore the space between the second guide wheel supports 28 is not narrowed. That is, the shock-absorbing rod 30 is subjected to only the force in the vehicle body outside direction, which is received from the second guide wheels 16, so that the space between the second guide wheel supports 28 is widened when the force acts.

Although not shown in the figures, in this embodiment, a bogie on the rear side of the vehicle 1 has the same configuration as that of the above-described embodiment.

Thus, according to the bogie for a guide rail type vehicle in accordance with this embodiment, in the vehicle body end-side part 10*a* of the guide frame 10, the pair of first guide wheel supports 25 arranged so as to be opposed to each other in the axle direction is turnably provided; each of the pair of first guide wheels 14 is attached to the vehicle body end-side part 10*a* of the guide frame 10 via each of the pair of first guide wheel supports 25; the pair of first guide wheels 14 is connected to each other by the shock-absorbing rod 27; in the vehicle body center-side part 10*b* of the guide frame 10, the pair of second guide wheel supports 28 arranged so as to be opposed to each other in the axle direction is turnably provided; each of the pair of second guide wheels 16 is attached to the vehicle body center-side part 10*b* of the guide frame 10 via each of the pair of second guide wheel supports 28; and the pair of second guide wheels 16 is connected to each other by the shock-absorbing rod 30. Therefore, when the bogie 2 runs in a curved portion of the guide rail 4 or on a joint etc. of the guide rail 4, shocks received by the first and second guide wheels 14 and 16 are absorbed by the shock-absorbing rods 27 and 30, respectively, and the shocks are restrained from being transmitted to the guide frame 10 and the bogie 2. Thereby, the running stability of the bogie 2 is improved, so that the riding comfort of passengers in the vehicle 1 can be improved. Also, since the shocks applied to the first and second guide wheels 14 and 16 themselves are decreased by the shock-absorbing rods 27 and 30, respectively, the lives of the first and second guide wheels 14 and 16 can be prolonged.

Fifth Embodiment

Figure 7:
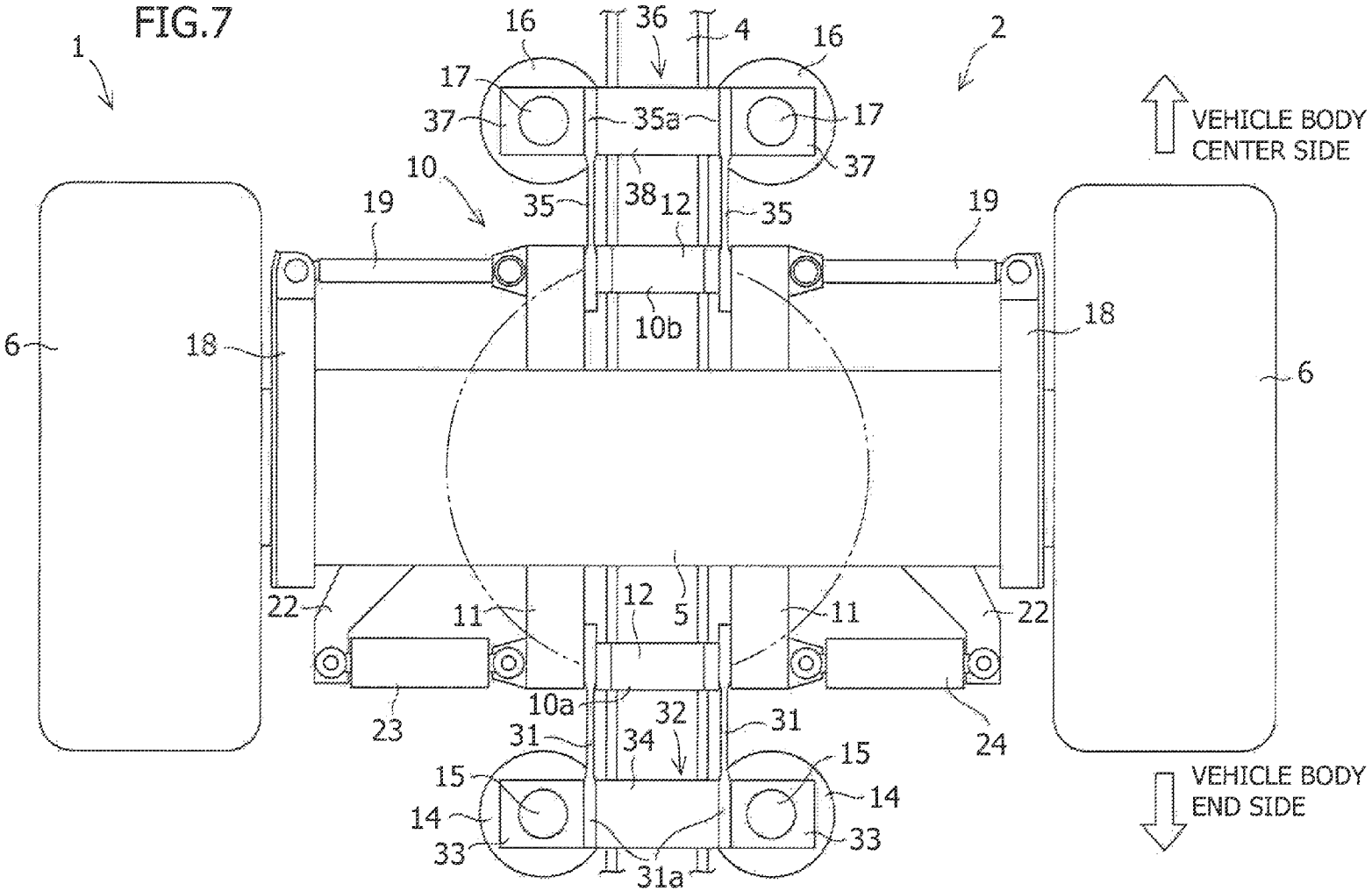
FIG. 7 is a plan view of a bogie on the front side in the vehicle longitudinal direction of a guide rail type vehicle in accordance with a fifth embodiment of the present invention.

A bogie for a guide rail type vehicle in accordance with a fifth embodiment of the present invention will now be described with reference to the accompanying drawings. FIG. 7 is a plan view of a bogie on the front side in the vehicle longitudinal direction of a guide rail type vehicle in accordance with the fifth embodiment of the present invention. In this embodiment, the same symbols are applied to elements that are the same as those explained in the above-described embodiments, and repeated explanation thereof is omitted.

In this embodiment, as shown in FIG. 7, a pair of first leaf springs 31 is provided in the vehicle body end-side part 10*a* of the guide frame 10. The pair of first leaf springs 31 is arranged so as to be opposed to each other with the guide rail 4 being held therebetween. The pair of first leaf springs 31 is arranged so as to extend toward the vehicle body end-side, and to vehicle body end-side parts 31*a* of the pair of first leaf springs 31, a first split-type guide wheel support (guide wheel supporting member) 32 is attached.

The first split-type guide wheel support 32 includes a pair of guide wheel attaching parts 33 arranged in both end portions in the vehicle lateral direction, and a middle supporting part 34 arranged between the guide wheel attaching parts 33. To each of the guide wheel attaching parts 33, the first guide wheel 14 is rotatably attached via the rotation shaft 15. Also, each of the vehicle body end-side parts 31*a* of the first leaf springs 31 is held between the guide wheel attaching part 33 and the middle supporting part 34.

Also, in this embodiment, as shown in FIG. 7, a pair of second leaf springs 35 is provided in the vehicle body center-side part 10*b* of the guide frame 10. The pair of second leaf springs 35 is arranged so as to be opposed to each other with the guide rail 4 being held therebetween. The pair of second leaf springs 35 is arranged so as to extend toward the vehicle body center-side, and to vehicle body center-side parts 35*a* of the pair of second leaf springs 35, a second split-type guide wheel support (guide wheel supporting member) 36 is attached.

The second split-type guide wheel support 36 includes a pair of guide wheel attaching parts 37 arranged in both end portions in the vehicle lateral direction, and a middle supporting part 38 arranged between the guide wheel attaching parts 33. To each of the guide wheel attaching parts 37, the second guide wheel 16 is rotatably attached via the rotation shaft 17. Also, each of the vehicle body center-side parts 35*a* of the second leaf springs 35 is held between the guide wheel attaching part 37 and the middle supporting part 38.

Although not shown in the figures, in this embodiment, a bogie on the rear side of the vehicle 1 has the same configuration as that of the above-described embodiment.

Thus, according to the bogie for a guide rail type vehicle in accordance with this embodiment, the pair of first guide wheels 14 is supported by the first split-type guide wheel support 32; in the vehicle body end-side part 10*a* of the guide frame 10, the pair of first leaf springs 31 arranged so as to be opposed to each other in the axle direction is provided; the first split-type guide wheel support 32 is attached to the vehicle body end-side part 10*a* of the guide frame 10 via the pair of first leaf springs 31; the pair of second guide wheels 16 is supported by the second split-type guide wheel receiving member 36; in the vehicle body center-side part 10*b* of the guide frame 10, the pair of second leaf springs 35 arranged so as to be opposed to each other in the axle direction is provided; and the second split-type guide wheel support 36 is attached to the vehicle body center-side part 10*b* of the guide frame 10 via the pair of second leaf springs 35. Therefore, when the bogie 2 runs in a curved portion of the guide rail 4 or on a joint etc of the guide rail 4, shocks received by the first and second guide wheels 14 and 16 are absorbed by the first and second leaf springs 31 and 35, respectively, and the shocks are restrained from being transmitted to the guide frame 10 and the bogie 2. Thereby, the running stability of the bogie 2 is improved, so that the riding comfort of passenger on the vehicle 1 can be improved. Also, since the shocks applied to the first and second guide wheels 14 and 16 themselves are decreased by the first and second leaf springs 31 and 35, respectively, the lives of the first and second guide wheels 14 and 16 can be prolonged.

Further, since the leaf springs, which are not worn-out parts, are used to connect the first and second split-type guide wheel supports 32 and 36 to the guide frame 10, the exchange period becomes longer, and the maintainability is also improved.

Sixth Embodiment

Figure 8:
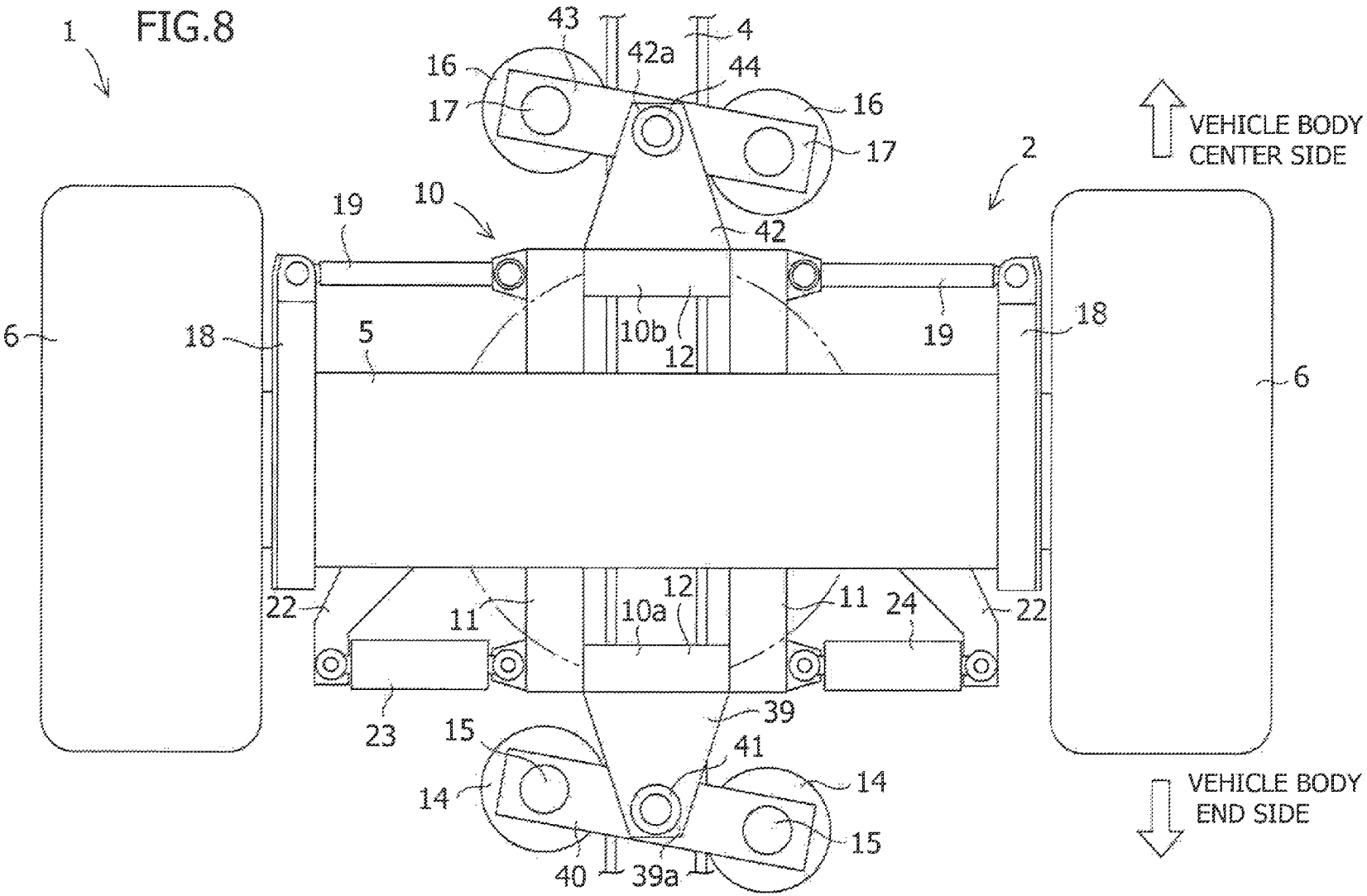
FIG. 8 is a plan view of a bogie on the front side in the vehicle longitudinal direction of a guide rail type vehicle in accordance with a sixth embodiment of the present invention.

A bogie for a guide rail type vehicle in accordance with a sixth embodiment of the present invention will now be described with reference to the accompanying drawings. FIG. 8 is a plan view of a bogie on the front side in the vehicle longitudinal direction of a guide rail type vehicle in accordance with the sixth embodiment of the present invention. In this embodiment, the same symbols are applied to elements that are the same as those explained in the above-described embodiments, and repeated explanation thereof is omitted.

In this embodiment, as shown in FIG. 8, in the vehicle body end-side part 10*a* of the guide frame 10, a first link support 39 extending to the vehicle body end-side is provided. The first link support 39 is formed into a trapezoidal shape in plan view, and to a vehicle body end-side part 39*a* of the first link support 39, a first link 40 is attached so as to tilt with respect to the guide rail 4.

To both end portions in the vehicle lateral direction of the first link 40, the pair of first guide wheels 14 is rotatably attached via the rotation shafts 15. Each of the first guide wheels 14 is configured so as to come into contact with the outside side surface 4*a* (refer to FIG. 2) of the guide rail 4 in the state in which the first link 40 tilts with respect to the guide rail 4.

Also, the first link 40 is attached rotatably to the first link support 39 via a first rubber vibration isolator (shock-absorbing mechanism) 41 having a restoring function. Thereby, the configuration is made such that the first link 40 is returned to the original tilt position by the restoring function of the first rubber vibration isolator 41 after rotation. Also, the inner width between the first guide wheels 14 attached to both the end portions of the first link 40 is at the maximum when the first link 40 is at right angles to the guide rail 4, and is not widened more because of the structure. That is, the structure such that the first link 40 is attached rotatably to the first link support 39, itself, also has a function as a stopper for restricting the inner width between the first guide wheels 14.

Also, in this embodiment, as shown in FIG. 8, in the vehicle body center-side part 10*b* of the guide frame 10, a second link support 42 extending to the vehicle body center-side is provided. The second link support 42 is formed into a trapezoidal shape in plan view, and to a vehicle body center-side part 42*a* of the second link support 42, a second link 43 is attached so as to tilt with respect to the guide rail 4.

To both end portions in the vehicle lateral direction of the second link 43, the second guide wheels 16 are rotatably attached via the rotation shafts 17. Each of the second guide wheels 16 is configured so as to come into contact with the outside side surface 4*a* (refer to FIG. 2) of the guide rail 4 in the state in which the second link 43 tilts with respect to the guide rail 4.

Also, the second link 43 is attached rotatably to the second link support 42 via a second rubber vibration isolator (shock-absorbing mechanism) 44 having a restoring function. Thereby, the configuration is made such that the second link 43 is returned to the original tilt position by the restoring function of the second rubber vibration isolator 44 after rotation. Also, the inner width between the second guide wheels 16 attached to both the end portions of the second link 43 is at the maximum when the second link 43 is at right angles to the guide rail 4, and is not widened more because of the structure. That is, the structure such that the second link 43 is attached rotatably to the second link support 42, itself, also has a function as a stopper for restricting the inner width between the second guide wheels 16.

Although not shown in the figures, in this embodiment, a bogie on the rear side of the vehicle 1 has the same configuration as that of the above-described embodiment.

Thus, according to the bogie for a guide rail type vehicle in accordance with this embodiment, the pair of first guide wheels 14 is connected to each other by the first link 40 arranged so as to tilt with respect to the guide rail 4; in the vehicle body end-side part 10*a* of the guide frame 10, the first link support 39 extending toward the vehicle body end-side is provided; the first link 40 is attached rotatably to the first link support 39 via the first rubber vibration isolator 41 having a restoring function; the pair of second guide wheels 16 is connected to each other by the second link 43 arranged so as to tilt with respect to the guide rail 4; in the vehicle body center-side part 10*b* of the guide frame 10, the second link support 42 extending toward the vehicle body center-side is provided; and the second link 43 is attached rotatably to the second link support 42 via the second rubber vibration isolator 44 having a restoring function. Therefore, when the bogie 2 runs in a curved section of the guide rail 4 or on a joint etc, of the guide rail 4, shocks received by the first and second guide wheels 14 and 16 are absorbed by the turning of the first and second links 40 and 43, respectively, and the shocks are restrained from being transmitted to the guide frame 10 and the bogie 2. Thereby, the running stability of the bogie 2 is improved, so that the riding comfort of passenger on the vehicle 1 can also be improved. Also, since the shocks applied to the first and second guide wheels 14 and 16 themselves are decreased by the turning of the first and second links 40 and 43, respectively, the lives of the first and second guide wheels 14 and 16 can be prolonged.

Also, even if an abnormal load is applied to the first and second guide wheels 14 and 16, the first and second links 40 and 43 can be returned to the original tilt position by the use of the first and second rubber vibration isolators 41 and 44.

Further, the inner widths between the first guide wheels 14 and between the second guide wheels 16 attached to both the end portions of the first and second links 40 and 43, respectively, become at the maximum when the first and second links 40 are at right angles to the guide rail 4, and are not widened more because of the structure. That is, the structures such that the first and second links 40 and 43 are attached rotatably to the first and second link supports 39 and 42, respectively, themselves, also have a function as stoppers for restricting the inner widths between the first guide wheels 14 and between the second guide wheels 16.

The above is a description of the embodiments of the present invention. The present invention is not limited to the above-described embodiments, and various modifications and changes can be made based on the technical concept of the present invention.

In the above-described first to sixth embodiments, the guide rail 4 is formed into an H shape in cross section. However, as shown in FIG. 9, a guide rail 45 may be formed into a U shape in cross section.

Figure 9A:
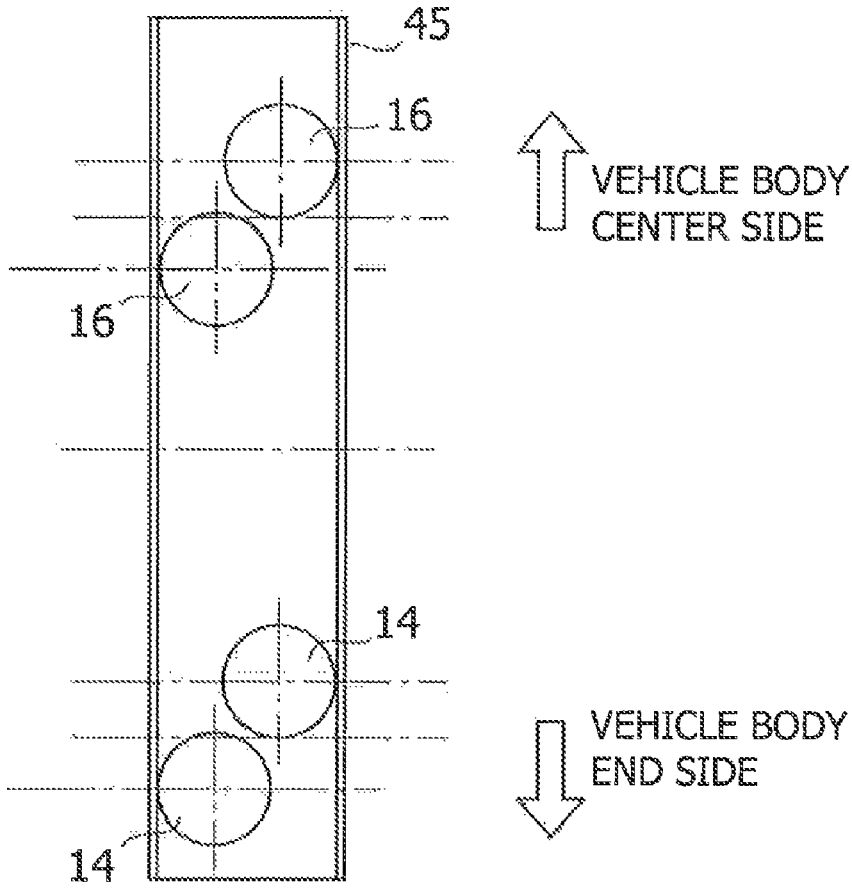
FIG. 9(*a*) and FIG. 9(*b*) are a plan view and a sectional view, respectively, showing a modification of a guide rail for a guide rail type vehicle in accordance with the present invention.
Figure 9B:
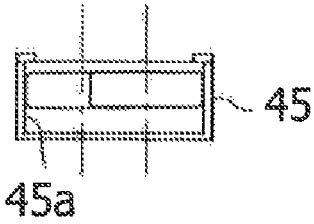
Figure 10:
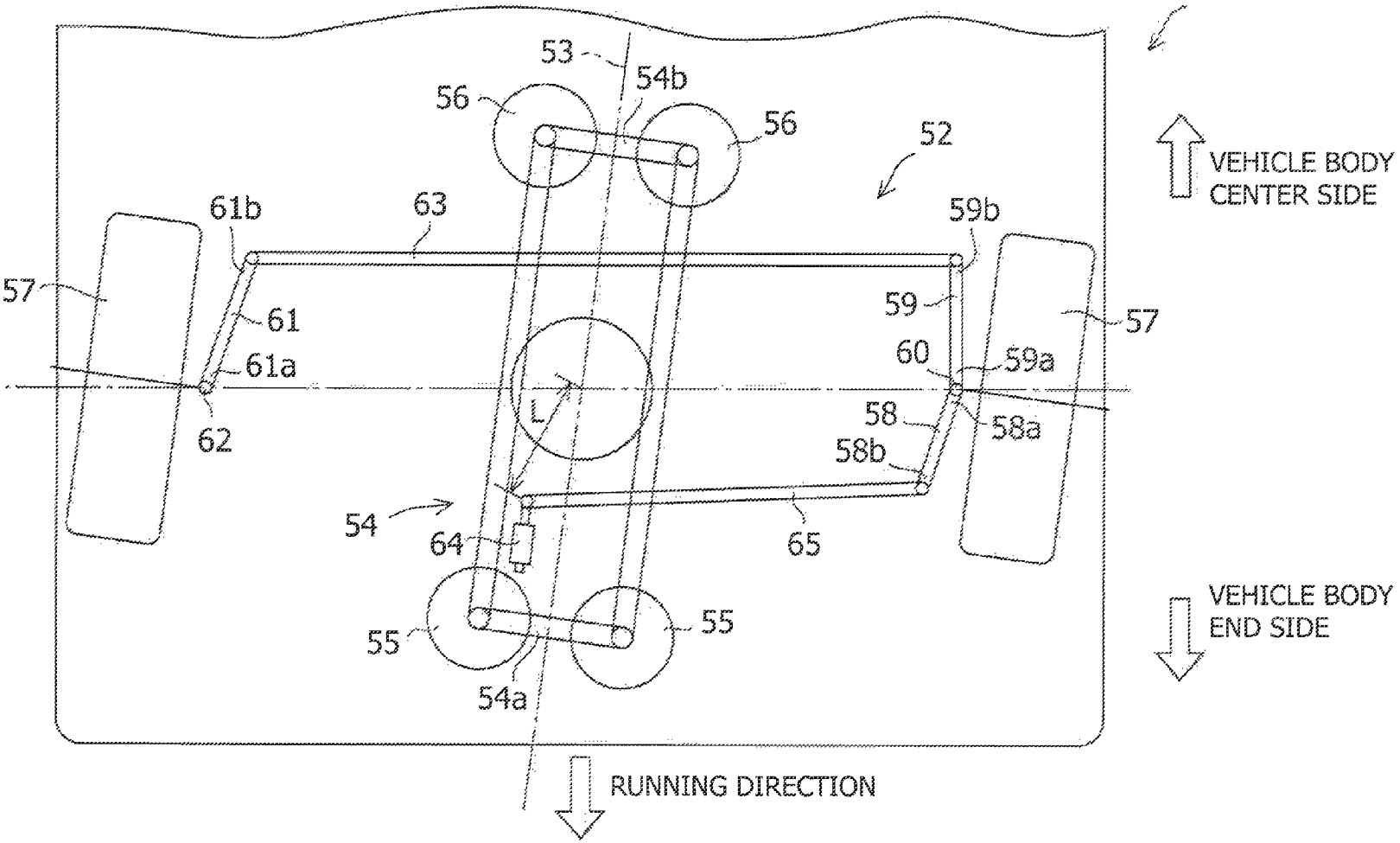
FIG. 10 is a plan view of a bogie on the front side in the vehicle longitudinal direction of a conventional guide rail type vehicle.

In this case, as shown in FIG. 9(*a*), the pair of first guide wheels 14 is arranged in the guide frame 10 so as to be adjacent to each other in the axle direction. Similarly, the pair of second guide wheels 16 is arranged in the guide frame 10 so as to be adjacent to each other in the axle direction. As shown in FIG. 9(*b*), the first guide wheel 14 and the second guide wheel 16 are arranged so as to be in contact with an inside side surfaces 45*a* of the guide rail 45.

In the above-described first to sixth embodiments, the guide frame 10 is attached to the axle 5 by using the frames 8. However, the guide frame 10 may be attached to the axle 5 directly via the bearings 9 without the use of the frames 8.

In the above-described second to sixth embodiments, the arms 22 for attaching the turning damper 23 and the restoring rod 24 are provided on the frame 8. However, the arms 22 may be provided on the axle 5 directly without the use of the frames 8.

In the above-described fourth embodiment, the shock-absorbing rods 27 and 30 each are provided with the stopper. However, the rotation to the vehicle body center side of the first and second guide wheel supports 25 and 28 may be prevented without the use of the stoppers. For example, the configuration may be such that when the first and second guide wheel supports 25 and 28 are going to turn toward the vehicle body center side, the end portions on the guide frame 10 side of the first and second guide wheel supports 25 and 28 come into contact with the guide frame 10, whereby the first and second guide wheel supports 25 and 28 are prevented from turning toward the vehicle body center side.

In the above-described sixth embodiment, the first rubber vibration isolator 41 and the second rubber vibration isolator 44 are used as the shock-absorbing mechanisms. However, the shock-absorbing mechanism is not limited to these means, and any other member having torsional operation, such as a torsion spring, may be used as long as the turned first and second links 40 and 43 can be returned to the original tilt position.

DESCRIPTION OF SYMBOLS

1 vehicle
2, 2A, 2B bogie
3 guideway
4, 45 guide rail
4*a*, 45*a* side surface of guide rail
5 axle
5*a* lower surface of axle
5*b* running wheel nearby part of axle
6 running wheel
7 support
7*a* lower end of support
8 frame
8*a* upper surface of frame
9 bearing
10 guide frame
10*a* vehicle body end-side part of guide frame
10*b* vehicle body center-side part of guide frame
11 longitudinal frame
11*a* vehicle body center-side part of longitudinal frame
11*b* vehicle body end-side part of longitudinal frame
12 transverse frame
13 bearing holding member
13*a* lower surface of bearing holding member

14, 16 guide wheel
15, 17, 26, 29 rotation shaft
18 tie rod arm
18*a* vehicle body center-side end part of tie rod arm
19 tie rod
19*a* vehicle body outside end part of tie rod
20, 21 joint
22 arm
22*a* end part on the vehicle body end-side of arm
23 turning damper
24 restoring rod
25, 28 guide wheel support
25*a* vehicle body center-side part of guide wheel support
27, 30 shock-absorbing rod
28*a* vehicle body end-side part of guide wheel support
31, 35 leaf spring
31*a* vehicle body end-side part of leaf spring
32, 36 split-type guide wheel receiving member
33, 37 guide wheel attaching part of split-type guide wheel support
34, 38 middle supporting part of split-type guide wheel support
35*a* vehicle body center-side part of leaf spring
39, 42 link support
40, 43 link
41, 44 rubber vibration isolator
51 (prior art) guide rail type vehicle
52 (prior art) bogie
53 (prior art) guide rail
54 (prior art) guide frame
55, 56 (prior art) guide wheel
57 (prior art) running wheel
58 (prior art) steering lever
59, 61 (prior art) link lever
60, 62 (prior art) rotation shaft
63 (prior art) tie rod
64 (prior art) actuator
65 (prior art) steering rod
O distance from center axis of axle to guide frame center
$O_1$ guide frame center
$O_2$ center axis of axle
P surplus centrifugal load
CF1, CF2 cornering force acting on running wheel
$\alpha f$, $\alpha r$ slip angle of running wheel

The invention claimed is:

1. A bogie for a guide rail type vehicle steered by being guided by a guide rail provided on a predetermined guideway when running on the guideway, comprising:

an axle in which a pair of running wheels is steerably mounted at both ends of the axle;

a guide frame which is arranged under the axle, is attached turnably to the axle via a bearing, and is formed so as to extend in the vehicle longitudinal direction;

a pair of first guide wheels which is arranged adjacently to each other in the vehicle lateral direction so as to be in contact with the guide rail, and is provided rotatably in the vehicle body end-side part in the vehicle longitudinal direction of the guide frame;

a pair of second guide wheels which is arranged adjacently to each other in the vehicle lateral direction so as to be in contact with the guide rail, and is provided rotatably in the vehicle body center-side part in the vehicle longitudinal direction of the guide frame;

a pair of tie rod arms which is arranged so as to be opposed to each other with the guide rail being held therebetween, is attached to the axle, and is formed so as to extend from the axle to the vehicle body center-side; and a pair of tie rods each connecting the guide frame to each of the pair of tie rod arms, wherein one end of each of the tie rods is attached rotatably to the tie rod arm, and the other end of each of the tie rods is attached rotatably to the guide frame, wherein the pair of the first guide wheels and the pair of the second guide wheels are arranged symmetric to each other in the vehicle longitudinal direction about a turning center axis of the guide frame, and the center axis of the axle is arranged nearer the vehicle body center in the vehicle longitudinal direction with respect to the turning center axis of the guide frame.

2. The bogie for a guide rail type vehicle according to claim 1, further comprising:

a turning damper connected between the guide frame and the axle, and wherein the turning damper restrains the turning operation of the guide frame; and a restoring rod connected between the guide frame and the axle, and wherein the restoring rod restores the guide frame to a straight running state after the turning operation of the guide frame.

3. The bogie for a guide rail type vehicle according to claim 2, further comprising:

a pair of first guide wheel supports which is turnably provided in the vehicle body end-side part of the guide frame, the pair of first guide wheel supports being arranged so as to be opposed to each other in the axle direction, each of the pair of first guide wheels being attached to the vehicle body end-side part of the guide frame via each of the pair of first guide wheel supports, and the pair of first guide wheels being connected to each other by a shock-absorbing rod; and a pair of second guide wheel supports which is turnably provided in the vehicle body center-side part of the guide frame, the pair of second guide wheel supports being arranged so as to be opposed to each other in the axle direction, each of the pair of second guide wheels being attached to the vehicle body center-side part of the guide frame via each of the pair of second guide wheel supports, and the pair of second guide wheels being connected to each other by a shock-absorbing rod.

4. The bogie for a guide rail type vehicle according to claim 2, further comprising:

a first link which connects the pair of first guide wheels to each other, and is arranged so as to tilt with respect to the guide rail;

a first link support which is provided in the vehicle body end-side part of the guide frame, the first link support extending to the vehicle body end side in the vehicle longitudinal direction, and the first link being attached rotatably to the first link support via a first shock-absorbing mechanism having a restoring function;

a second link which connects the pair of second guide wheels to each other, and is arranged so as to tilt with respect to the guide rail; and a second link support which is provided in the vehicle body center-side part of the guide frame, the second link support extending to the vehicle body center-side in the vehicle longitudinal direction, and the second link being attached rotatably to the second link support via a second shock-absorbing mechanism having a restoring function.

5. A bogie for a guide rail type vehicle steered by being guided by a guide rail provided on a predetermined guideway when running on the guideway, comprising:

an axle in which a pair of running wheels is steerably mounted at both ends of the axle;

a guide frame which is arranged under the axle, is attached turnably to the axle via a bearing, and is formed so as to extend in the vehicle longitudinal direction;

a pair of first guide wheels which is arranged adjacently to each other in the vehicle lateral direction so as to be in contact with the guide rail, and is provided rotatably in the vehicle body end-side part in the vehicle longitudinal direction of the guide frame;

a pair of second guide wheels which is arranged adjacently to each other in the vehicle lateral direction so as to be in contact with the guide rail, and is provided rotatably in the vehicle body center-side part in the vehicle longitudinal direction of the guide frame;

a pair of tie rod arms which is arranged so as to be opposed to each other with the guide rail being held therebetween, is attached to the axle, and is formed so as to extend from the axle to the vehicle body center-side;

a pair of tie rods each connecting the guide frame to each of the pair of tie rod arms, wherein one end of each of the tie rods is attached rotatably to the tie rod arm, and the other end of each of the tie rods is attached rotatably to the guide frame;

a turning damper connected between the guide frame and the axle, and wherein the turning damper restrains the turning operation of the guide frame;

a restoring rod connected between the guide frame and the axle, and wherein the restoring rod restores the guide frame to a straight running state after the turning operation of the guide frame; and, a first guide wheel supporting member which connects the pair of first guide wheels to each other;

a pair of first leaf springs which is provided in the vehicle body end-side part of the guide frame, and is arranged so as to be opposed to each other in the axle direction, the first guide wheel supporting member being attached to the vehicle body end-side part of the guide frame via the pair of first leaf springs;

a second guide wheel supporting member which connects the pair of second guide wheels to each other; and a pair of second leaf springs which is provided in the vehicle body center-side part of the guide frame, and is arranged so as to be opposed to each other in the axle direction, the second guide wheel supporting member being attached to the vehicle body center-side part of the guide frame via the pair of second leaf springs.

* * * * *